US005617106A

United States Patent [19]

Tahmassebpur

[11] Patent Number: 5,617,106

[45] Date of Patent: Apr. 1, 1997

[54] PIVOTABLE ANTENNA AND ELECTRICAL DEVICE HAVING A PIVOTABLE ANTENNA

[75] Inventor: Mohammed Tahmassebpur, Vancouver, Canada

[73] Assignee: Sierra Wireless, Inc., Richmond, Canada

[21] Appl. No.: 425,745

[22] Filed: Apr. 20, 1995

[51] Int. Cl.[6] ..... H01Q 1/24; H01Q 1/50

[52] U.S. Cl. ..... 343/702; 343/906; 439/916

[58] Field of Search ..... 343/702, 872, 343/873, 888, 906; 439/916, 578, 581; 455/99, 347, 351; 174/65 R, 75 C, 88 C, 152 A, 253 A; 285/184, 311, 312

[56] References Cited

U.S. PATENT DOCUMENTS

| | | | |
|---|---|---|---|
| 4,001,830 | 1/1977 | Ishimaru et al . | 343/702 |
| 4,066,324 | 1/1978 | Stephens | 343/906 |
| 4,081,750 | 3/1978 | Herr et al. | 343/702 |
| 4,471,493 | 9/1984 | Schober | 343/702 |
| 5,170,173 | 12/1992 | Krenz et al. | 343/702 |
| 5,218,370 | 6/1993 | Blaese | 343/702 |
| 5,255,001 | 10/1993 | Tamura et al. | 343/906 |
| 5,271,684 | 12/1993 | Phillips | 403/106 |
| 5,440,315 | 8/1995 | Wright et al. | 343/906 |
| 5,467,477 | 11/1995 | Furuta et al. | 343/702 |

FOREIGN PATENT DOCUMENTS

| | | | |
|---|---|---|---|
| 2616288 | 3/1977 | Germany | 343/882 |
| 0306703 | 12/1990 | Japan | H01Q 1/24 |
| WO95/13665 | 5/1995 | WIPO . | |

*Primary Examiner*—Donald T. Hajec
*Assistant Examiner*—Tan Ho

[57] ABSTRACT

In a pivotable antenna assembly, a pivot rod is provided having an axial opening therein at a first end thereof and a radial opening extending to the axial opening. An antenna is provided, the antenna having an antenna element and a portion through which a portion of the pivot rod extends such that the axial opening of the pivot rod is inside the portion of the antenna. A coaxial cable having a first end is provided, the coaxial cable including a central conductor, a dielectric material around the conductor, a shielding material around the dielectric material, and a jacket around the dielectric material, the first end of the coaxial cable extending into the axial opening of the pivot rod, the shielding being attached to an interior wall of the pivot rod, and the conductor extending through the radial opening and being attached to the antenna element. A method for making a pivotable antenna assembly is also disclosed.

25 Claims, 4 Drawing Sheets

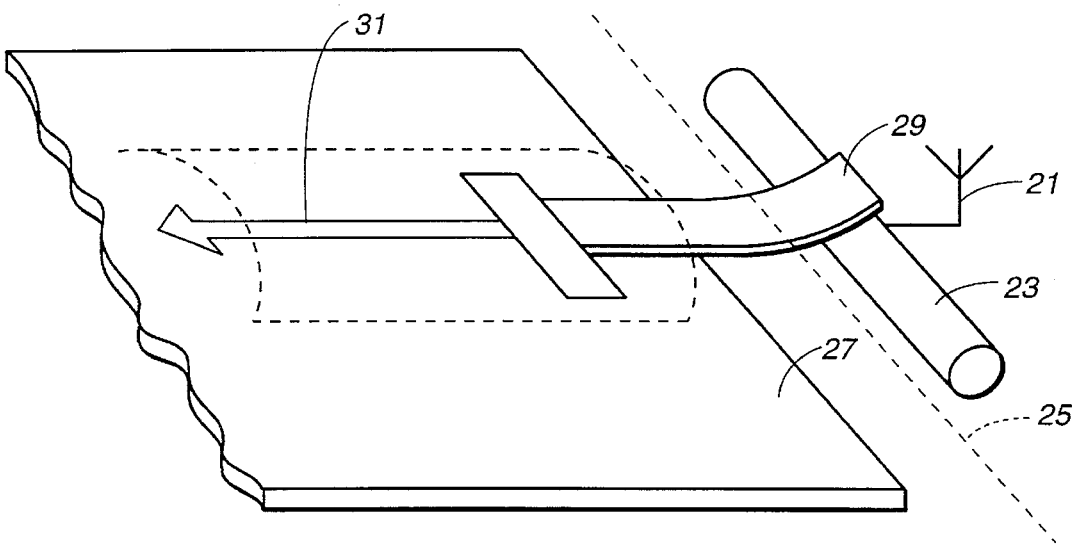
FIG._1
(PRIOR ART)
FIG._2
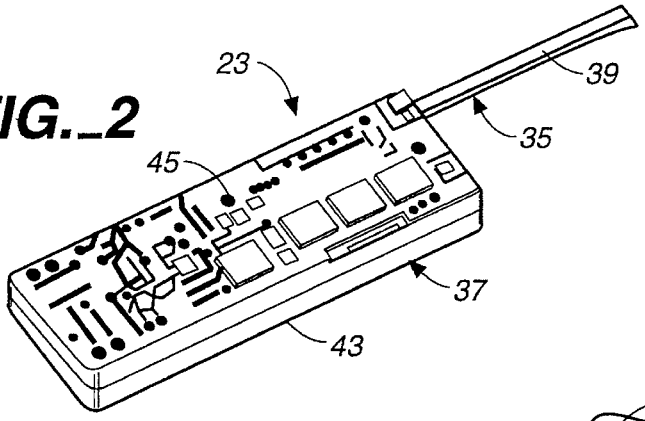
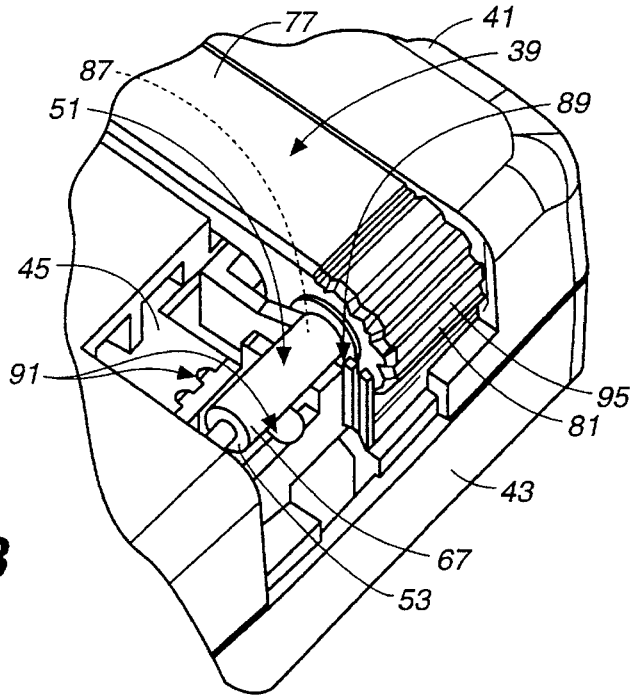
FIG._3

PIVOTABLE ANTENNA AND ELECTRICAL DEVICE HAVING A PIVOTABLE ANTENNA

BACKGROUND OF THE INVENTION

1. Field of the Invention

The present invention relates to antennas and, more particularly, pivotable antennas.

2. State of the Art

In electrical devices that require antennas, such as radios and the like, high frequency electrical signals must be conducted from the antenna to grounded electrical equipment, usually mounted on a printed circuit board (PCB) inside of a casing. Antennas that pivot from a closed position to an open position are increasing popular in such devices. In these electrical devices, it is necessary to minimize interference with the high frequency signal as it is transmitted from the antenna to the electrical equipment.

The equipment for conducting the high frequency signals from the antenna to the electrical equipment that is believed to be the one most commonly used today is shown schematically in FIG. 1. An antenna 21 is mounted on a conductive shaft 23 that is pivotable relative to a casing 25 in which electrical equipment such as a PCB 27 is mounted. A flexible, conductive finger 29 is grounded, usually soldered, to the PCB and extends outside of the shielded casing 25 and contacts the shaft 23. A shielded trace 31 inside of the casing 25 connects the finger 29 to the rest of the electrical equipment. The disadvantages of this conventional technique include the need for multiple interconnected elements between the antenna and the electrical equipment, such as the shaft, the finger, the trace, etc. The connections between these elements permit dissipation of the signal, and shielding of the elements is difficult and space consuming.

The inventor has recognized that it would be desirable to use a coaxial cable as all or part of the link between the antenna and the electrical equipment to minimize interference with the high frequency signal. Coaxial cables typically comprise a central conductor, a dielectric material around the conductor, a shielding material, usually braided wires, around the dielectric material, and a jacket, usually plastic, around the shielding material.

However, one problem that has been encountered with pivotable antennas, is the difficulty of attaching a delicate coaxial cable to an antenna that pivots. The torsional forces that are created upon pivoting the antenna often tend to be too great for the delicate cable. Accordingly, it is desirable to provide a pivotable antenna assembly that minimizes the effects of torsional forces in a coaxial cable when an antenna pivots relative to a portion of an attached coaxial cable.

SUMMARY OF THE INVENTION

In accordance with one aspect of the present invention, an electrical device having a pivotable antenna assembly is provided. The electrical device includes a conductive pivot rod having an axial opening therein at a first end thereof and a radial opening extending to tile axial opening. The electrical device further includes an antenna having an antenna element and a portion through which a portion of the pivot rod extends such that the axial opening of the pivot rod is inside the portion of the antenna. A coaxial cable having a first end is provided, the coaxial cable including a central conductor, a dielectric material around the conductor, a shielding material around the dielectric material, and a jacket around the dielectric material, the first end of the coaxial cable extending into the axial opening of the pivot rod, the shielding being attached to an interior wall of the pivot rod, and the conductor extending through the radial opening and being attached to tile antenna element. The electrical device further includes a casing for electrical equipment, the casing including a casing bore for receiving a second portion of the pivot rod such that tile pivot rod contacts a wall of the casing bore and is pivotable in the casing bore, at least a surface of tile wall of the casing bore being a conductive material such that the pivot rod is grounded by the conductive material.

According to another aspect of the present invention, a pivotable antenna assembly is provided. The antenna assembly includes a pivot rod having an axial opening therein at a first end thereof and a radial opening extending to the axial opening. The antenna assembly also includes an antenna having an antenna element and a portion through which a portion of the pivot rod extends such that the axial opening of the pivot rod is inside the portion of the antenna. The antenna assembly further includes a coaxial cable having a first end, the coaxial cable including a central conductor, a dielectric material around the conductor, a shielding material around the dielectric material, and a jacket around the dielectric material, the first end of the coaxial cable extending into the axial opening of the pivot rod, the shielding being attached to an interior wall of the pivot rod, and the conductor extending through the radial opening and being attached to the antenna element.

According to yet another aspect of the present invention, a method for making a pivotable antenna assembly is provided. According to the method, a spacer clip is attached to an antenna element. A conductive pivot rod is inserted inside a semicircular end portion of the spacer clip, the pivot rod having an axial opening and a radial opening. A conductor of a coaxial cable is attached to the antenna element, the conductor extending through the radial opening of the pivot rod into the axial opening of the pivot rod, the coaxial cable extending out of a first end of the pivot rod.

BRIEF DESCRIPTION OF THE DRAWINGS

The present invention can be further understood with reference to the following description in conjunction with the appended drawings, wherein like elements are provided with the same reference numerals. In the drawings:

FIG. 1 is a schematic perspective view of a pivotable antenna assembly according to the prior art;

FIG. 2 is a perspective view of an electrical device, shown without a top casing portion, having a pivotable antenna assembly according to an embodiment of the present invention, the antenna being shown in the open position;

FIG. 3 is a perspective view of a portion of an electrical device of FIG. 2 shown with the antenna in the closed position;

DETAILED DESCRIPTION OF THE PREFERRED EMBODIMENT

Figure 4:
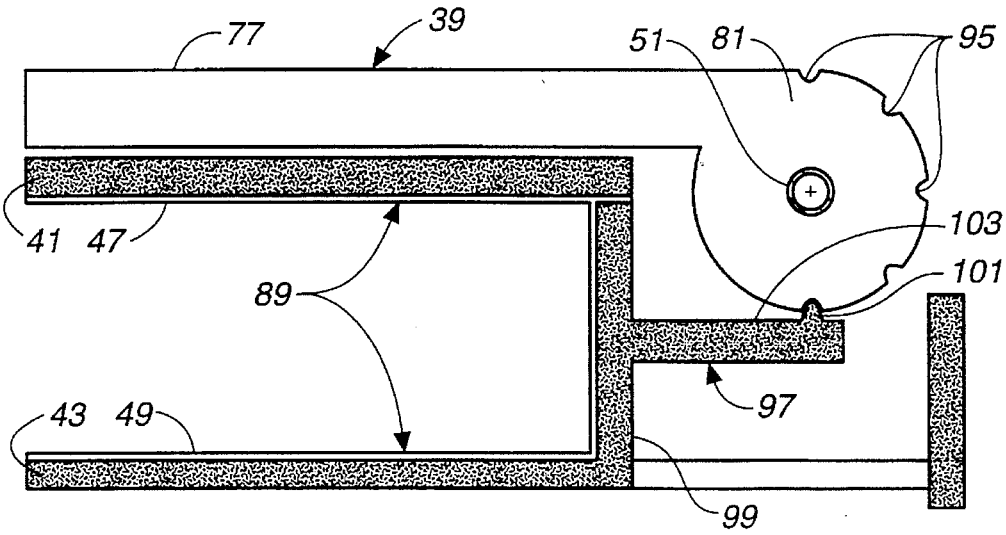
FIG. 4 is schematic, cross-sectional view of a portion of an electrical device having a pivotable antenna assembly according to an embodiment of the present invention.
Figure 5A:
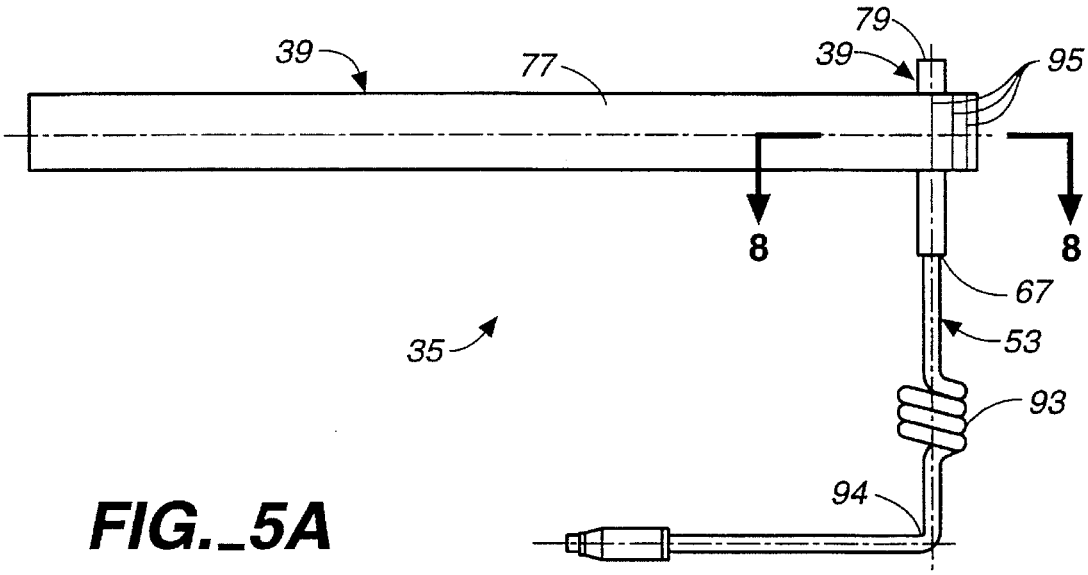
FIGS. 5A and 5B are top and side plan views, respectively, of a pivotable antenna assembly according to an embodiment of the present invention.
Figure 5B:
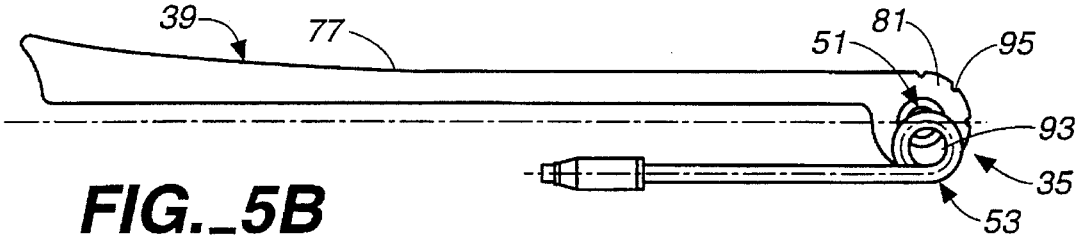

An electrical device 33 having a pivotable antenna assembly 35 according to the present invention is shown in FIG. 2. An enlarged view of a portion of the connection of the pivotable antenna assembly 35 to the casing 37 of the electrical device is shown in perspective in FIG. 3 and shown schematically in FIG. 4. The pivotable antenna assembly 35 includes an antenna 39 that is pivotable between an open position (FIG. 2) and a closed position (FIGS. 3 and 4).

The electrical device 33 may be any device that uses a pivotable or retractable antenna, such as a radio or a cellular phone. The illustrated electrical device is a portion of the PocketPlus modem manufactured by Sierra Wireless Inc., Richmond, BC, Canada. The device 33 includes the casing 37, which includes a top half 41 (not shown in FIG. 1), a bottom half 43 attachable to the top half, and electrical equipment, which is preferably mounted on a PCB 45 that is entirely enclosed by the top and bottom halves. The inside walls 47 and 49 of the top half 41 and the bottom half 43 are preferably coated with a conductive material, preferably a plated material, to provide good shielding for the electrical equipment disposed inside of the casing 37. The top and bottom halves 41 and 43 are preferably otherwise formed of plastic.

As shown in FIGS. 5A, 5B, 6, 7, and 8, the antenna assembly 35 includes the antenna 39, a pivot rod 51, and a coaxial cable 53. The antenna 39 preferably includes an antenna element 55 that is attached to a central conductor 57 of the coaxial cable 53, the cable including a dielectric layer 59 around the conductor, a shielding layer 61 around the dielectric layer, and a jacket 63 around tile shielding layer.

Figure 6:
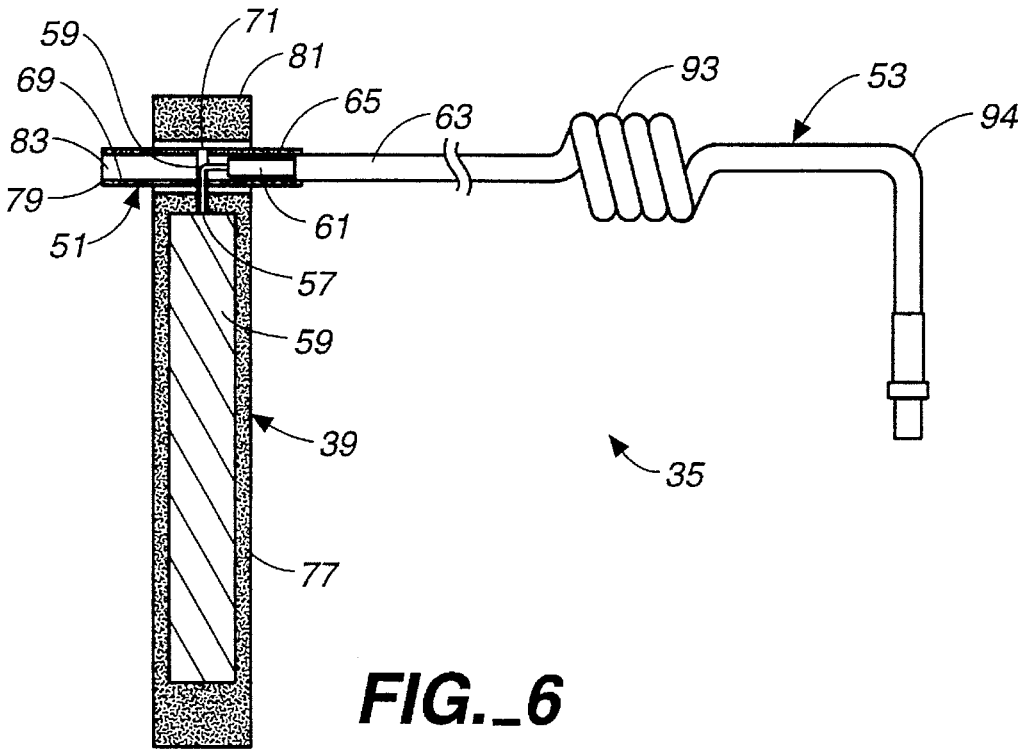
FIG. 6 is a cross-sectional view of a pivotable antenna assembly according to an embodiment of the present invention.
Figure 7:
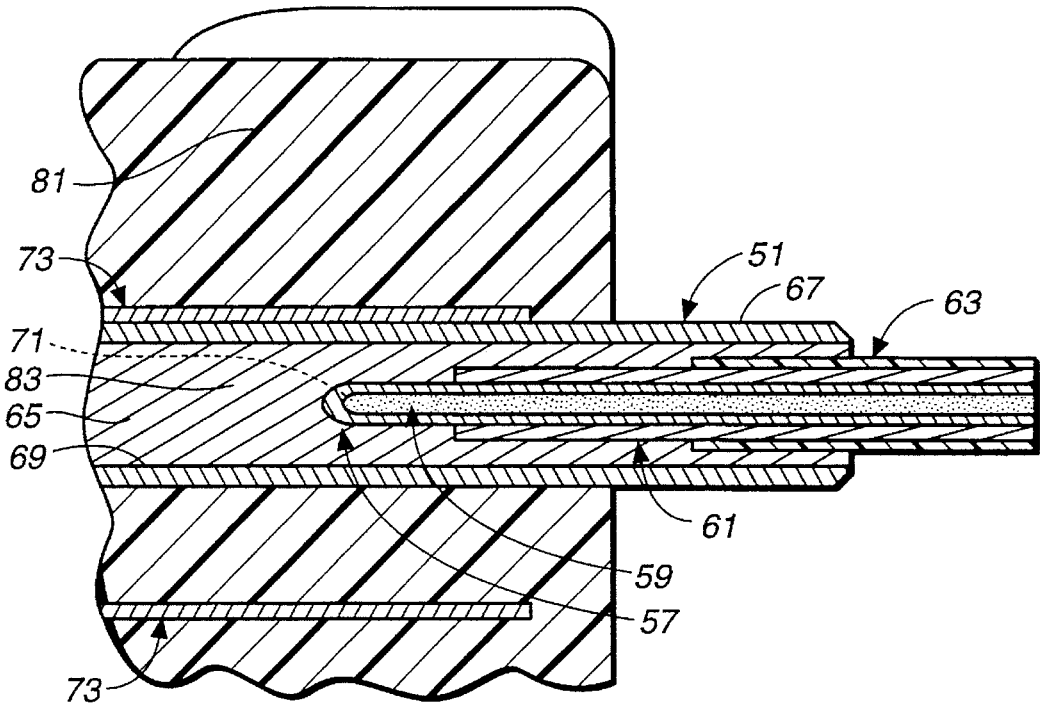
FIG. 7 is a cross-sectional view taken at section 7—7 of FIG. 5A.
Figure 8:
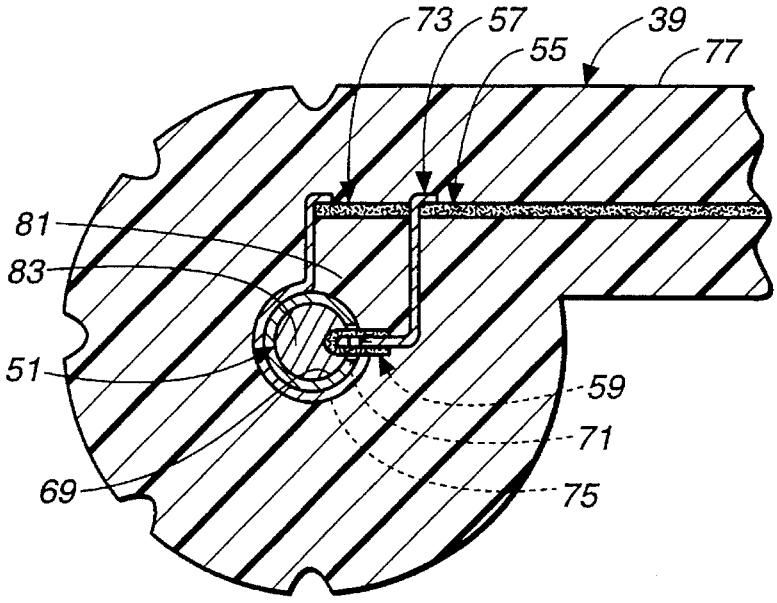
FIG. 8 is a cross-sectional view taken at section 8—8 of FIG. 5A.

As shown in FIGS. 6, 7, and 8, a first end of the coaxial cable 53 is received in an axial bore or opening 65 in a first end 67 of the pivot rod 51, and the shielding layer 61 is secured to an interior wall 69 of the pivot rod, which is preferably a conductive, metallic rod, preferably a rolled or machined brass pin having a gold and nickel plating.

The shielding layer 61 is preferably soldered to the interior wall 69, but might also be secured to the wall by other techniques, such as crimping. The conductor 57 and the dielectric layer 59 extend through a radial bore or opening 71 in the pivot rod 51 for connection of the conductor to the antenna element 55.

As shown in FIGS. 7 and 8, a spacer clip 73 is attached to the antenna element 55, preferably by soldering, and forms, at an end thereof, a semi-circular shape 75 for tightly holding a portion of the pivot rod 51. A plastic antenna housing 77 is preferably insert molded around tile antenna element 55, the spacer clip 73, and a portion of the pivot rod 51 so that first and second ends 67 and 79 of the pivot rod extend out of sides of a bottom portion 81 of the housing 77, the bottom portion preferably being substantially cylindrical. By insert molding the pivot rod 51 inside of the housing 77, the pivot rod is thus preferably non-rotatable relative to the housing and the antenna element 55.

Figure 9:
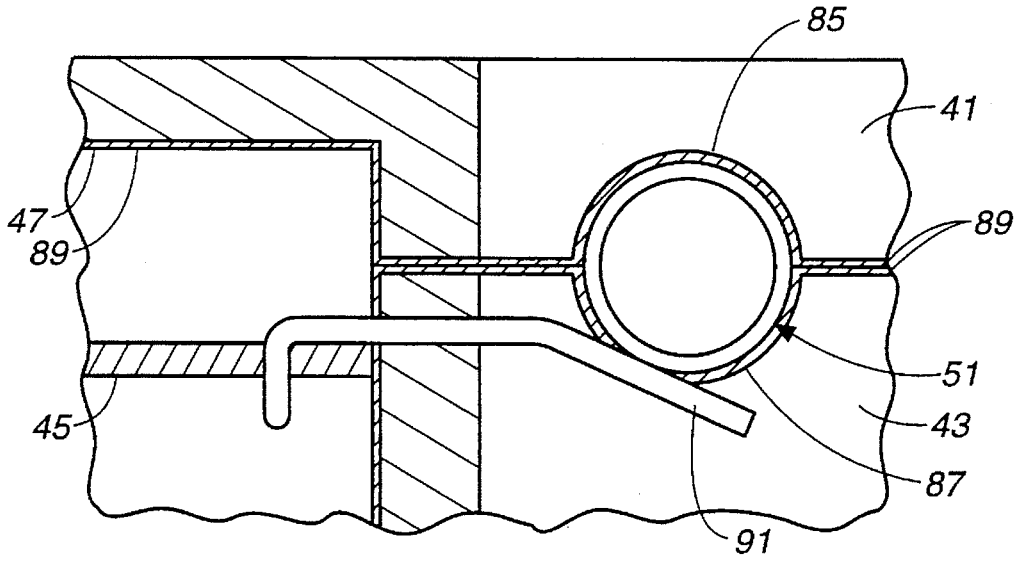
FIG. 9 is a schematic, cross-sectional view showing the pivotable mounting of the pivot rod to the casing according to the present invention.

As shown in FIGS. 6 and 7, the second end 79 of the pivot rod 51 is preferably plugged with a conductive material plug 83, preferably solder for holding the portion of the coaxial cable 53 in the axial opening 65 of tile pivot rod. As shown in FIG. 9, the first and second ends 67 and 79 of the pivot rod 51 are preferably pivotably received in openings formed when the top half 41 and the bottom half 43 of the casing 37 are attached together such that grooves 85 in the top half are aligned with grooves 87 in the bottom half. The interior surfaces of the grooves 85 and 87 are preferably coated with a conductive material coating 89, like the interior walls 47 and 49 of the top and bottom halves 41 and 43 of the casing, and contact between the coating and the pivot rod 51 grounds the pivot rod to tile casing 37. Thus, the pivot rod 51 grounds the antenna 39 to the casing.

The portions of the coaxial cable 53 inside of the pivot rod 51 are shielded from interference by the pivot rod and the plug 83, and tile portions of the coaxial cable extending outside of the first end 67 of the pivot rod are, of course, shielded by the shielding layer 61. In this manner, interference with the high frequency signal carried by the conductor 57 is minimized in the region before the coaxial cable is able to enter the shielded interior of the casing 37. Moreover, the coaxial cable 53 comprises the only element interconnecting the antenna element 55 and the electrical equipment on the PCB.

As shown in FIG. 3, the pivot rod 51 is preferably also grounded by means of a flexible metallic finger or leaf spring element 91 that preferably extends through a wall of the casing 37, such as by extending between the top and bottom halves 41 and 43, and is attached therein to the grounded PCB 45. The element 91 contacts the outside surface of the pivot rod in a manner similar to the manner in which the prior art finger 29 contacts the shaft 23, as discussed above. Thus, according to the preferred embodiment, the pivot rod 51 is preferably grounded not only due to its contact with the conductive material 89 in the grooves 85 and 87, but also by the finger or leaf spring element 91, thereby further ensuring good grounding.

Because pivoting of the antenna 39 develops torsional forces in the coaxial cable 53 which causes adverse effects in the cable, such as destruction of the shielding layer 61, it is preferred to use a double served coaxial cable which is better able to absorb such torsional forces, such as the #CXA 8339, seven strand conductor, double served wire shielding cable available from W. L. Gore, Manor, Texas. In addition, it is preferred to provide a series of permanent helical winds 93, preferably three and one-half, in the cable 53 to help absorb the torsional forces. A permanent bend 94 is preferably formed in a portion of the coaxial cable alter the winds 93 to direct the cable to a connector on the PCB 45.

As shown in FIG. 4, the cylindrical bottom portion 81 of the antenna housing 77 is preferably provided with a plurality of recesses 95 provided circumferentially around the periphery of the bottom portion. The recesses 95 are preferably in the form of grooves extending along the entire width of the bottom portion 81, but may, instead, be in the form of circular recesses. A resilient member 97, preferably cantilevered, extends out of a side wall 99 of the casing 37 and has a protuberance 101 that is receivable in the recesses 95 extending up from a top surface 103 of the resilient member. The resilient member 97 is preferably formed as part of the casing 37 but may, instead, be a separate part mounted thereon. The recesses 95 and the protuberance 101 are preferably formed with sides that are sufficiently sloped to facilitate turning the antenna 39 relative to the resilient member but also ensure that, when the protuberance is received in a recess, it is not easily removable except upon the application of some force to the antenna. By providing recesses 95 at desired angular locations around the periphery of the bottom portion 81, the antenna 39 can be locked in a variety of angular relationships to the casing 37.

In a method for making the antenna assembly 35, the conductor 57 of the coaxial cable 53 is led through the axial opening 65 and the radial opening 71 of the pivot rod 51 and is attached, preferably by soldering, to the antenna element 55. The pivot rod 51 is fit inside the semi-circular end portion 75 of the spacer clip 73. The spacer clip 73 is attached to the antenna element 55, preferably by soldering. The shielding layer 61 of the coaxial cable 53 is secured to an inside wall 69 of the pivot rod 51, such as by soldering or crimping. The spacer clip 73, the antenna element 55, and a portion of the pivot rod 51 including the radial opening 71 are insert molded inside of an antenna housing 77. One or more helical winds 93 are permanently formed in the coaxial cable 53 outside of the pivot rod 51. The axial opening 65 at the second end 79 of the pivot rod 51 is plugged with a conductive material plug 83 such as solder.

It is, of course, possible to embody the present invention in specific forms other than those described above without departing from the spirit of the present invention. The embodiments shown are merely illustrative and should not be considered restrictive in any way. The scope of the present invention is given in the appended Claims, rather than in the preceding description, and all variations and equivalents which tall within the range of the Claims are intended to be embraced therein.

What is claimed is:

1. An electrical device having a pivotable antenna assembly, comprising:

a conductive pivot rod having an axial opening therein at a first end thereof and a radial opening extending to the axial opening;

an antenna having an antenna element and a portion through which a portion of the pivot rod extends such that the radial opening of the pivot rod is inside the portion of the antenna;

a coaxial cable having a first end, the coaxial cable including a central conductor, a dielectric material around the conductor, a shielding material around the dielectric material, and a jacket around the dielectric material, the first end of the coaxial cable extending into the axial opening of the pivot rod, the shielding being attached to an interior wall of the pivot rod, and the conductor extending through the radial opening and being attached to the antenna element; and a casing for electrical equipment, the casing including a casing bore for receiving a second portion of the pivot rod such that the pivot rod contacts a wall of the casing bore and is pivotable in the casing bore, at least a surface of the wall of the casing bore being a conductive material such that the pivot rod is grounded by the conductive material.

2. The electrical device as set forth in claim 1, further comprising a conductive member grounded to electrical equipment housed in the casing, an end of the conductive member being forced against the pivot rod for grounding the pivot rod.

3. The electrical device as set forth in claim 2, wherein the conductive member is a leaf spring.

4. The electrical device as set forth in claim 1, wherein the shielding of the coaxial cable is attached to the interior wall of the pivot rod by solder.

5. The electrical device as set forth in claim 1, wherein the shielding of the coaxial cable is attached to the interior wall of the pivot rod by a crimp in the pivot rod.

6. The electrical device as set forth in claim 1, wherein the coaxial cable is a double served coaxial cable.

7. The electrical device as set forth in claim 1, wherein a portion of the coaxial cable is helically wound to absorb torsional forces caused by pivoting the antenna relative to the casing.

8. The electrical device as set forth in claim 1, wherein the antenna includes an antenna housing formed around the antenna element.

9. The electrical device as set forth in claim 8, wherein a bottom portion of the antenna housing is substantially cylindrical, the portion of the antenna through which the portion of the pivot rod extends including an antenna bore extending axially through the substantially cylindrical bottom portion of the antenna housing.

10. The electrical device as set forth in claim 9, wherein the cylindrical bottom portion of the antenna housing has a plurality of recesses provided circumferentially around the cylindrical bottom portion, and a resilient member having a protuberance receivable in the recesses and formed on a surface of the resilient member extends outwardly from a wall of the casing such that the surface of the resilient member is substantially adjacent the cylindrical bottom portion of the antenna, wherein, when the antenna is pivoted relative to the casing, the resilient member yields sufficiently to permit the protuberance to exit and enter successive ones of the recesses, the protuberance being received in a selected one of the recesses to hold the antenna in a desired angular relationship to the casing.

11. The electrical device as set forth in claim 10, wherein the antenna housing is plastic.

12. The electrical device as set forth in claim 1, wherein the antenna is linked directly to electrical equipment inside of the casing by the coaxial cable.

13. The electrical device as set forth in claim 1, wherein conductive material closes a second end of the pivot rod and is attached to the pivot rod.

14. The electrical device as set forth in claim 13, wherein the conductive material closing the second end of the pivot rod is a plug of conductive material.

15. A pivotable antenna assembly, comprising:

a pivot rod having an axial opening therein at a first end thereof and a radial opening extending to the axial opening;

an antenna having an antenna element and a portion through which a portion of the pivot rod extends such that the radial opening of the pivot rod is inside the portion of the antenna; and a coaxial cable having a first end, the coaxial cable including a central conductor, a dielectric material around the conductor, a shielding material around the dielectric material, and a jacket around the dielectric material, the first end of the coaxial cable extending into the axial opening of the pivot rod, the shielding being attached to an interior wall of the pivot rod, and the conductor extending through the radial opening and being attached to the antenna element.

16. The pivotable antenna assembly as set forth in claim 15, wherein a portion of the coaxial cable is helically wound to absorb torsional forces caused by pivoting the antenna relative to a portion of the coaxial cable.

17. The pivotable antenna assembly as set forth in claim 15, wherein the shielding of the coaxial cable is attached to the interior wall of the pivot rod by solder.

18. The pivotable antenna assembly as set forth in claim 15, wherein the shielding of the coaxial cable is attached to the interior wall of the pivot rod by a crimp in the pivot rod.

19. The pivotable antenna assembly as set forth in claim 15, wherein the coaxial cable is a double served coaxial cable.

20. The pivotable antenna assembly as set forth in claim 15, wherein the pivot rod is formed of a conductive material.

21. A method for making a pivotable antenna assembly, comprising the steps of:

attaching a spacer clip to an antenna element;

inserting a conductive pivot rod inside a semi-circular end portion of the spacer clip, the pivot rod having an axial opening and a radial opening; and attaching a conductor of a coaxial cable to the antenna element, the conductor extending through the radial opening of the pivot rod into the axial opening of the pivot rod, the coaxial cable extending out of a first end of the pivot rod.

22. The method as set forth in claim 21, comprising the further step of securing a shielding layer of the coaxial cable to an inside wall of the pivot rod.

23. The method as set forth in claim 21, comprising the further step of insert molding the spacer clip, the antenna element, and a portion of the pivot rod including the radial opening inside of an antenna housing.

24. The method as set forth in claim 21, comprising the further step of permanently forming one or more helical winds in the coaxial cable outside of the pivot rod.

25. The method as set forth in claim 21, comprising the further step of plugging the axial opening at a second end of the pivot rod with a conductive material.

* * * * *